United States Patent [19]

Congleton et al.

[11] 4,194,682

[45] Mar. 25, 1980

[54] EGG CARTON

[76] Inventors: Wayne L. Congleton, 20780 Divonne Dr., Walnut, Calif. 91789; Pat E. Placey, 11033 Massachusetts Ave., Los Angeles, Calif. 90025

[21] Appl. No.: 4,745

[22] Filed: Jan. 19, 1979

[51] Int. Cl.[2] ..... B65D 5/66; B65D 5/50

[52] U.S. Cl. ..... 229/45 EC; 229/2.5 EC; 229/29 E

[58] Field of Search ..... 229/2.5 EC, 28 EC, 44 EC, 229/45 EC; 206/561, 562, 563, 488

[56] References Cited

U.S. PATENT DOCUMENTS

| | | | |
|---|---|---|---|
| 1,681,700 | 8/1928 | Folmer | 229/45 EC |
| 1,744,956 | 1/1930 | Fischer | 229/29 E X |
| 1,902,167 | 3/1933 | Hassell et al. | 229/29 E X |
| 1,975,127 | 10/1934 | Sherman | 229/2.5 EC X |
| 2,418,248 | 4/1947 | Denton | 229/29 M |
| 3,100,593 | 8/1963 | Alsman | 229/2.5 EC |
| 3,176,899 | 4/1965 | McMahon | 229/29 M |
| 3,392,902 | 7/1968 | Donovan | 229/2.5 EC X |

*Primary Examiner*—Davis T. Moorhead
*Attorney, Agent, or Firm*—Edgar W. Averill, Jr.

[57] ABSTRACT

An egg carton having a lower carton portion having four generally flat side walls and an upper carton portion likewise having four generally flat side walls and an egg-supporting sheet held in the lower carton portion. The insert has an opening for each egg and is separte from the upper and lower portions of the carton.

10 Claims, 12 Drawing Figures

FIG. 4.
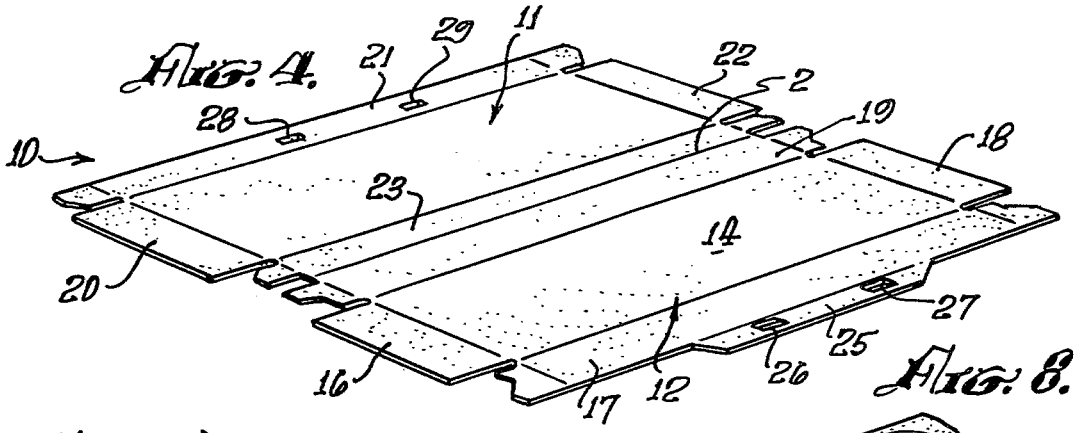
FIG. 8.
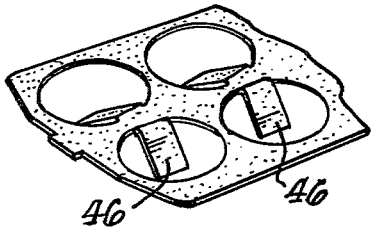
FIG. 5.
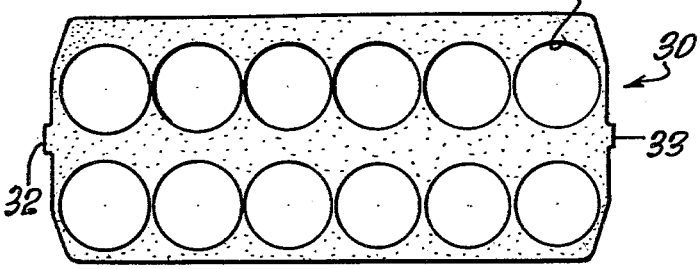
FIG. 9.
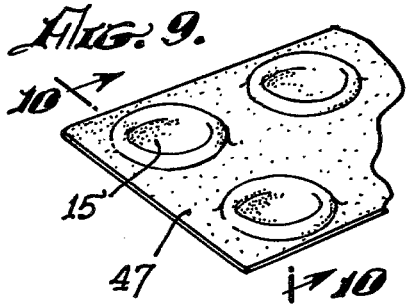
FIG. 6.
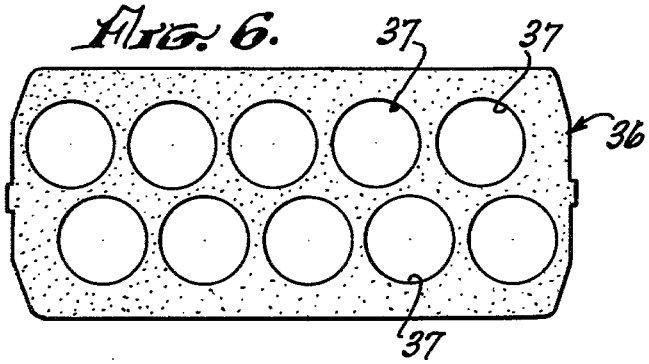
FIG. 10.
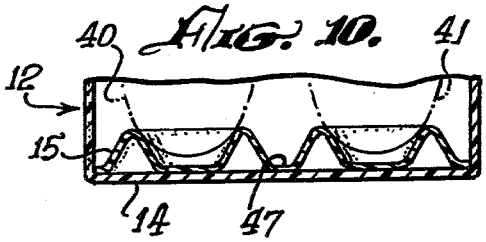
FIG. 7.
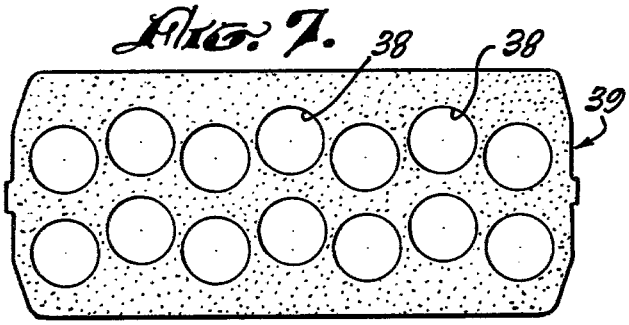
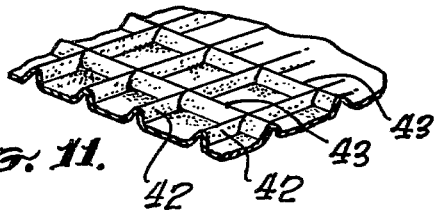
FIG. 11.

EGG CARTON

BACKGROUND OF THE INVENTION

The field of the invention is egg cartons and the invention relates more specifically to egg cartons of the type fabricated from a foamed plastic or from paper pulp.

Cartons for holding eggs have been in a gradual state of improvement and evolution for many years. The cardboard box with a cardboard grid insert has been replaced with a molded paper pulp carton, which in turn has been largely, but not entirely, replaced by molded foamed plastic cartons. Such molded plastic cartons typically are made from foamed polystyrene and have egg-shaped depressions in the lower part of the carton. These depressions hold and cushion the eggs, and help reduce breakage during filling, shipping, and handling of the cartons.

A major disadvantage of most molded foamed plastic cartons is their inability to hold eggs of different sizes and shapes. Eggs are graded according to size, based upon the weight of the egg. Two eggs which weigh the same, however, can have substantially different shapes. One may be practically spherical, whereas the other may be highly elongated. These egg shapes tend to vary throughout the year, and it is impractical to stock and/or manufacture enough different molded foamed plastic cartons to securely hold the various shapes of eggs. Furthermore, different egg cartons must be molded for different sizes of eggs. For instance, a molded foamed plastic egg carton made for extra large eggs typically should not be used for large eggs without undue breakage during handling. Still further, eggs larger than "extra large" (jumbo) or eggs smaller than medium (small or pee wee) are not commonly sold in supermarkets because they cannot be conveniently adapted to the standard egg carton. For instance, it is impractical or impossible to insert one dozen jumbo eggs in an egg carton having a standard exterior dimension. If the egg carton does not have the standard exterior dimension, it will not fit in the normal shipping cartons, and thus cannot be economically handled. Conversely, one dozen small or pee wee eggs does not provide a sufficient weight of eggs to make a practical purchase. It would be advantageous to provide an egg carton which has the capability of holding more than one dozen of such small eggs. Conversely, it would be advantageous to provide an egg carton which could hold less than one dozen, such as ten, jumbo eggs. It would likewise be useful to provide egg cartons having the capability of securely holding elongated and almost spheroidal eggs of the same size or weight class.

SUMMARY OF THE INVENTION

It is an object of the present invention to provide an egg carton capable of supporting eggs of various sizes and shapes.

The present invention is for an egg carton useful for various sizes and shapes of eggs. The carton has a rectangular horizontal bottom member having four generally flat side walls affixed thereto and positioned vertically with respect to the horizontal bottom member. An egg-supporting insert sheet having two opposing parallel sides is greater in width than the bottom member, and has approximately the same length as the bottom member. The insert sheet is fabricated from a stiff but flexible material so that when the sheet is inserted into the carton and against the bottom member, it flexes upwardly so that the uppermost portion of the insert arches upwardly and is between 45% and 65% and the total height of the egg carton. The insert sheet has a plurality of holes for the insertion of eggs therethrough. An upper carton portion is hingedly attached to one of the side walls which is affixed to the bottom member. The upper carton portion has a rectangular horizontal top member and four generally flat side walls positioned to be co-planar with the corresponding side walls of the lower carton portion when the upper carton portion is in a closed configuration.

BRIEF DESCRIPTION OF THE DRAWINGS

FIG. 4 is a perspective view of the egg carton of the present invention in an unfolded configuration.

FIG. 5 is a top plan view of the insert of the egg carton of FIG. 2.

FIG. 6 is a top plan view of an alternate embodiment of the insert of FIG. 5.

FIG. 7 is a top plan view of an alternate embodiment of the insert of FIG. 5.

FIG. 8 is a fragmentary perspective view of an alternate embodiment of the insert of FIG. 5.

FIG. 9 is a fragmentary perspective view of a bottom insert comprising an alternate embodiment of the bottom portion of the carton of FIG. 2.

FIG. 10 is a cross-sectional view taken along line 10—10 of FIG. 2.

FIG. 11 is a fragmentary perspective view of an alternate embodiment of the upper surface of the bottom of the egg carton of FIG. 2.

DESCRIPTION OF THE PREFERRED EMBODIMENTS

Figure 1:
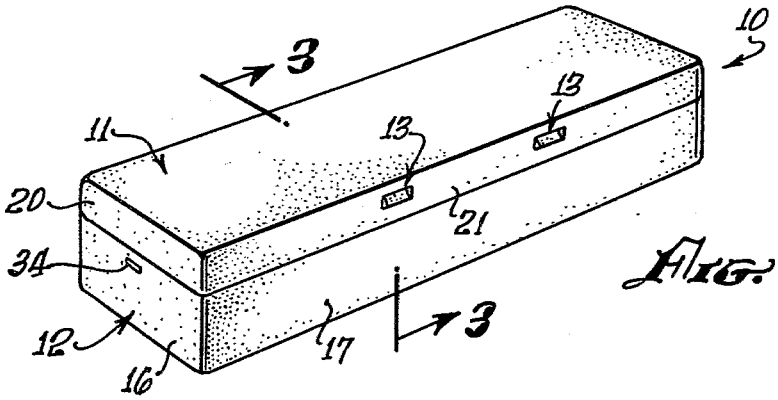
FIG. 1 is a perspective view of the exterior of the egg carton of the present invention.

An egg carton indicated generally by reference character 10 is shown in FIG. 1. The carton has an upper carton portion or lid 11, and a lower carton portion or tray 12. Latching means are indicated by reference character 13, and described more fully below.

The egg carton 10 may be fabricated from any suitable material, but a foamed polymer such as foamed polystyrene sheet having a thickness of between 0.05 inches to 0.10 inches is a preferred material of construction. Other materials such as paper pulp cartons may also be used, however, as well as other foamed or non-foamed polymers.

Figure 2:
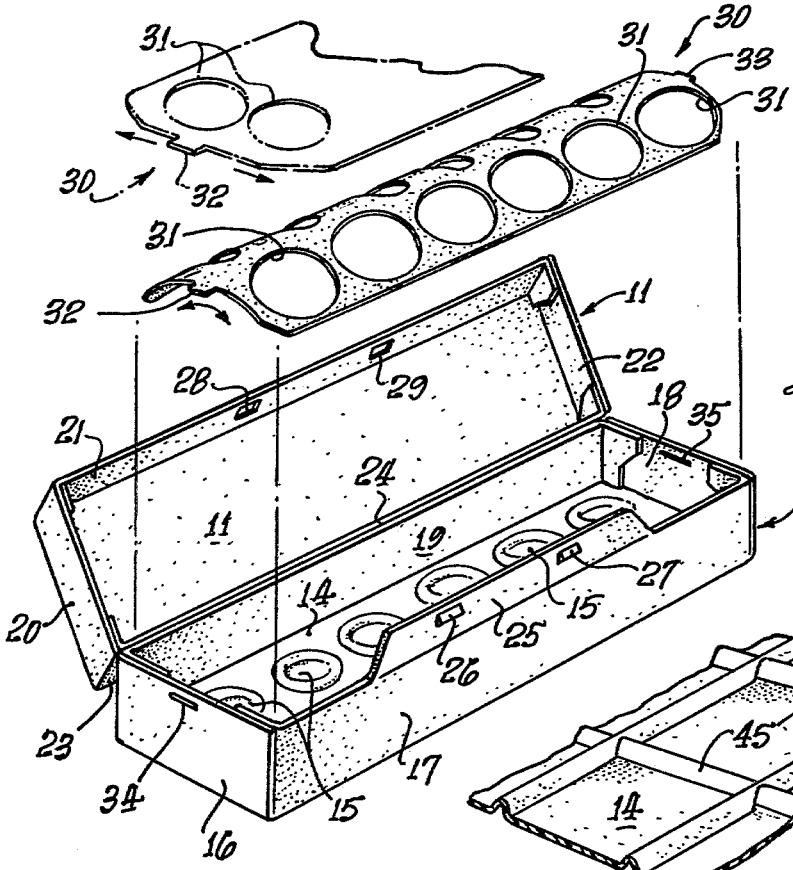
FIG. 2 is an exploded perspective view showing the interior of the egg carton of the present invention.
Figure 3:
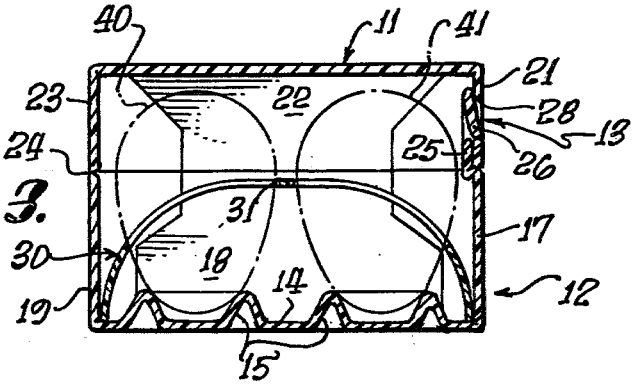
FIG. 3 is an enlarged cross-sectional view taken along line 3—3 of FIG. 1.

The egg carton 10 of FIG. 1 is shown in an opened configuration in FIG. 2. The bottom 14 has a plurality of egg-receiving supports 15, which may be integrally molded into the bottom of the carton as shown in FIG. 3, or may be provided by a separate insert such as shown in FIGS. 9 and 10. These supports should be high enough to prevent the egg from tilting and touching the side of the carton. A height of the circular support of about ¼ inch is satisfactory.

Four sides, 16 through 19, are attached to bottom 14. Sides 16 through 19 are generally vertical and flat, and are co-planar with sides 20 through 23 which are integral with lid 11 when lid 11 is in a closed position.

Lid 11 is hinged to tray 12 by hinge 24, which may be formed from the same sheet of plastic or paper pulp as sides 19 and 23. The latch 13 is of a relatively conventional design and has an inner flap 25 which has a pair of ears 26 and 27 which fit into openings 28 and 29 on side 21 of the lid.

The ability of the egg carton of the present invention to securely support eggs of different sizes and shapes occurs as a result of the use of an inner egg-supporting insert indicated in the drawings by reference character 30. Insert 30 has a plurality of holes 31 which are preferably circular for ease of manufacture but may be slightly elliptical if desired. Insert 30 is formed from a sheet of stiff but flexible material and foamed polystyrene sheeting having a thickness of about 25/1000ths of an inch is a preferred material of construction. Other polymers or even cardboard could be used in place of expanded or foamed polystyrene. Furthermore, oriented polystyrene can be used. It is important that the insert have sufficient flexibility to be moved from the flat configuration shown in phantom lines in FIG. 2 to the curved configuration shown in FIG. 2 and also shown in FIG. 3. It is also preferable that the insert have a pair of tabs 32 and 33 which fit into a pair of slots 34 and 35 formed in the end walls of the carton tray.

The insert is arched as shown in FIG. 2 of the drawings. The maximum height of the arch should be between 45% and 65% of the total inner height of the carton. About 50 percent is preferred.

The outer portion of the egg carton may be formed from a flat sheet cut in the manner shown in FIG. 4. This may be readily folded and glued or otherwise connected to form the carton such as shown in FIG. 1.

An important aspect of the carton of the present invention is its ability to be readily adapted, not only to hold eggs of different sizes and shapes, but to hold more or less than one dozen eggs per carton. It has not been heretofore practical to place a dozen jumbo eggs in a standard egg carton. The egg carton of the present invention, however, may be readily adapted to hold ten jumbo eggs by the use of an insert such as insert 36 having ten holes 37 cut therethrough. Similarly, more than twelve small or pee wee eggs may be held by holes 38 in insert 39 shown in FIG. 7. The insert shown in FIG. 2 is shown in plan view in FIG. 5.

The holding of an egg within the carton of the present invention is depicted in FIG. 3 where eggs 40 and 41 are shown in phantom lines. The bottom of the egg is held by egg-receiving supports 15, and the upper portion of the egg is held by holes 31 in insert 30. If eggs having a smaller vertical diameter are being packaged, then a different insert having smaller holes would be used in place of the standard insert. Eggs are sized by weight rather than by diameter. The egg shape, therefore, has a direct effect on the diameter of the eggs which have the identical weight. Egg shapes vary throughout the year, and it is possible by use of the present invention to vary the insert size depending on the average shape at any particular time of year. Thus, rather than using a different size carton for each different size of egg, it is possible to use the same outside carton with various inserts, depending upon the size and shape of the egg contained. This ability to use different inserts further greatly reduces the amount of carton inventory necessary. Instead of having to inventory cartons for small, medium, large, and extra large eggs, it is possible to keep a single size carton and inventory different inserts. Since the inserts may be stored in a flat condition such as shown in the phantom lines in FIG. 2, the insert storage takes up very little room, and all inserts fit within the same egg carton.

Several alternative means for holding the bottom of the egg are shown in FIGS. 9, 10, 11, and 12. If the egg carton has a flat bottom surface, a separate insert such as bottom insert 47 as shown in FIGS. 9 and 10 may be used. In this way, an insert having a number of eggs other than twelve may be accommodated. For instance, when packaging jumbo eggs with the insert of FIG. 6, a bottom insert having ten egg-receiving supports may be used.

Figure 12:
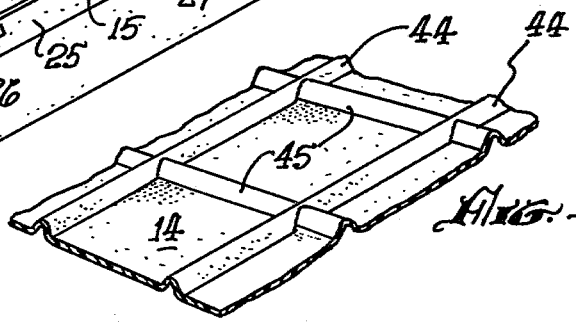
FIG. 12 is a fragmentary perspective view of an alternate embodiment of the upper surface of the bottom of the carton of FIG. 2.

The bottom support shown in FIGS. 11 and 12 are molded directly into the egg carton bottom. These supports not only provide a restriction to movement, but also serve to confine the spillage caused by broken eggs. The support of FIG. 11 shows a plurality of longitudinal ridges 42 and lateral ridges 43. These are both positioned closely enough together so that they may accommodate inserts such as those shown in FIGS. 5, 6, and 7 with the same egg carton. Alternatively, the ridges may be spaced at a greater distance such as that shown in FIG. 12 where longitudinal ridges 44 and lateral ridges 45 form one egg-receiving support for each of one dozen eggs.

Additional support for the egg may be provided by the insert by the addition of a plurality of tabs 46 which are integral with the insert. These tabs, although shown in FIG. 8 as integral with the center ridge of the insert, may be alternatively positioned so that they are integral with the outer edge of the holes, or a small tab may be provided along each edge, or at three, four, or more positions along the outer edge of each hole.

In place of the egg-receiving supports shown in the drawings, it is possible to use a second, arched insert similar to insert 30, which would be used in conjunction with insert 30 to support the egg at a lower or upper level. For instance, a lower insert having a height at its center of about one-half inch above the bottom and having smaller openings which correspond to the openings in the upper insert could be placed first in the bottom of the egg carton. Alternatively, an upper insert supported by the lid of the egg carton could be used to provide additional support for the eggs.

An additional advantage of the egg carton of the present invention is its ability to be readily printed because of its flat upper surface.

Egg cartons are typically shipped in cases of thirty dozen eggs where the cases are stacked five or six high. The carton of the present invention has an unusual ability to provide vertical support because of its vertical sides. In this way the eggs in cartons at the bottom of each case are more securely protected than those shipped in typical prior art cartons.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

What is claimed is:

1. An egg carton useful for various sizes and shapes of eggs, said carton comprising:

a rectangular, horizontal bottom member;

four generally flat side walls affixed to the bottom member and positioned vertically with respect to the bottom member, said side walls and bottom member forming a lower carton portion;

an egg-supporting insert sheet having two opposing parallel sides, said insert sheet being greater in width than the bottom member, said insert sheet being fabricated from a stiff piece of flexible material so that the sheet may be arched for insertion into the lower carton portion, the amount of the flexure being such that the uppermost portion of the insert sheet is between 45% and 65% of the total height of the egg carton, said insert sheet having a plurality of holes formed therein for insertion of eggs; and an upper carton portion, said upper carton portion having a rectangular, horizontal top member and four generally flat side walls positioned to be coplanar with the corresponding side walls of the lower carton portion when the upper carton portion is in a closed configuration.

2. The egg carton of claim 1 wherein the uppermost portion of the insert is about 50 percent the distance from the bottom member to the top when the top member is in a closed position.

3. The egg carton of claim 1 further including a second insert positioned between said first insert and the bottom of said carton.

4. The carton of claim 1 wherein the bottom of said carton contains a plurality of egg-receiving supports.

5. The carton of claim 4 wherein said supports are circular.

6. The carton of claim 1 wherein the holes in said insert sheet are circular.

7. The carton of claim 1 wherein said insert sheet has twelve holes.

8. The carton of claim 1 wherein said insert sheet has ten holes.

9. The carton of claim 1 wherein said insert sheet has fourteen holes.

10. The carton of claim 1 wherein said insert sheet is fabricated from foamed polystyrene.

* * * * *